United States Patent [19]

Shindo et al.

[11] Patent Number: 4,979,912

[45] Date of Patent: Dec. 25, 1990

[54] ELECTRICAL CONNECTOR

[75] Inventors: Mikio Shindo, Hachioji; Masanao Yoshida, Machida; Yukihisa Fujita, Kawasaki, all of Japan

[73] Assignee: AMP Incorporated, Harrisburg, Pa.

[21] Appl. No.: 494,257

[22] Filed: Mar. 14, 1990

[30] Foreign Application Priority Data

Mar. 17, 1989 [JP] Japan ..... 1-63563
Aug. 11, 1989 [JP] Japan ..... 1-208751

[51] Int. Cl.[5] ..... H01R 13/42
[52] U.S. Cl. ..... 439/595; 439/594
[58] Field of Search ..... 439/595, 594, 603

[56] References Cited

U.S. PATENT DOCUMENTS 4,329,009 5/1982 Bungo ..... 439/595
4,571,017 2/1986 Fujita ..... 439/595

*Primary Examiner*—Paula A. Bradley

[57] ABSTRACT

An electrical connector comprises a dielectric connector housing (30, 60) having contact-receiving cavities (31*a*, 62) in which electrical contacts (20, 50) are received, the contacts (20, 50) are received, the contacts (20, 50) have engaging projections (21, 54) extending upwardly from an upper surface which are engaged by free ends of resilient arms (37) extending inwardly from opposite sides of the contact-receiving cavities thereby restricting movement of the contacts in the contact-receiving cavities (31*a*, 62) in a direction opposite to that of the insertion direction. A vertical fin (23) is provided on the upper surface of the contacts (20, 50) and disposed between the resilient arms (37). The engaging projections (54) have a space (55) in which a rib (39) of an inner section of a wall of the contact-receiving cavities (31*a*, 62) is disposed.

8 Claims, 8 Drawing Sheets

23
26
25
20
26
21
40
41
42
42a
43
42
63a
64
63
30
31
31a
60
50
21
51
23
62
53
52

ELECTRICAL CONNECTOR

FIELD OF THE INVENTION

The invention relates to an electrical connector, more specifically to an electrical connector having a pair of resilient arms for firmly supporting and retaining a contact at a predetermined position in a contact-receiving cavity in a connector housing.

BACKGROUND OF THE INVENTION

Shown in FIG. 12 is a central cross-sectional view of one example of an electrical connector disclosed in Japanese Patent Publication No. 30270/76 which includes a connector housing 1 made of electrically-insulative material and is formed as a generally rectangular shape having a first engaging projection 6 extending downwardly from an upper wall 2. A second engaging projection 7 is formed extending upwardly from a bottom wall 3 in opposed relationship with the engaging projection 6. Also, formed downwardly on an inner surface 11 of the upper wall 2 with a certain slope is an arm 10 having a horizontal end portion where a curved section 12 and a step section 13 are formed.

Inserted in the above connector housing 1 toward the left direction in the drawing is an electrical contact 18 to which a conductor 17 is connected. That is, the contact 18 is slid along the outer surface of the curved section 12 against the resiliency of the arm 10 which returns to its initial position by the spring action of the arm 10 itself at the position where the back end of the upper surface 19 of the contact 18 passes the curved section 12; then, the back end of the contact 18 engages the step section 13 of the arm 10. A section 14 of the contact 18 is designed to have essentially the same longitudinal dimension as the distance between the first engaging projection 6 and the step section 13 of the arm 10 to fit the section 14 between the projection 6 and the arm 10, thereby restricting horizontal movement (right and left directions in the drawing) of the contact 18. On the other hand, the second engaging projection 7 on the lower wall abuts against a coupling projection 15 at the lower tip of the contact 18 to restrict forward movement of the lower end of the contact 18.

Support and retention means of the contact 18 within the connector housing 1 of a conventional electrical connector in the opposite direction to the insertion of such contact 18 is formed by the arm 10 extending from the inner surface of the upper wall 2 of the connector housing. To assure proper spring force of the arm 10, a space is provided between the tip of the arm 10 and the inner surface 11. This increases the eight of the connector housing 1, thereby making it very difficult to miniaturize such electrical connector. This is one of the problems to be solved by this invention.

SUMMARY OF THE PRESENT INVENTION

The present invention intends to solve such problem and to provide a low-profile connector housing to meet the requirements for miniaturization of such electrical connector while firmly supporting and securing the contact at a predetermined location within a contact-receiving cavity of the connector housing.

The electrical connector according to the present invention is directed to an electrical connector comprising a connector housing having contact-receiving cavities each defined by opposed top and bottom walls and a pair of opposed sidewalls, contacts to be inserted in the contact-receiving cavities, and contact-retention means to retain the contacts at a predetermined position in the contact-receiving cavities. It features that each of the contacts has an engaging projection extending upwardly from the upper surface of such contact, and the contact-retention means include a pair of resilient arms extending inwardly in each contact-receiving cavity from the opposed sidewalls thereof. The pair of resilient arms engage the engaging projection of the contact at the free ends of such resilient arms to restrict movement of the contact in the opposite direction to the insertion of the contact within the contact-receiving cavity.

Inserting each contact into a contact-receiving cavity of the connector housing from one end of the contact-receiving cavity, the engaging projection on the upper surface of the contact will push the opposed resilient arms horizontally toward the sidewalls to allow passage of the engaging projection. When the engaging projection passes the free ends of the resilient arms, the resilient arms tend to return to their initial horizontal locations by their resiliency. That is the stepped portions at the free ends of the resilient arms engage the rear end of the engaging projection of the contact in such a manner that the resilient arms firmly retain it, thereby restricting backward movement of the contact. Also, forward movement of the contact is restricted by abutting the front end of the contact to the front inner wall of the contact-receiving cavity.

The electrical connector according to another embodiment of the present invention is provided with a pair of horizontally-deflecting resilient arms and an anti-rotary structure between the contact and the housing. That is, the electrical connector comprises a housing having one or more contact-receiving cavity or cavities and one or more contact or contacts to be inserted at a predetermined position in the cavity or cavities. The electrical connector features an engaging projection extending upwardly from the upper surface of the contact, a vertical groove in the engaging projection along the direction of insertion of the contact, a rib in the contact-receiving cavity to be disposed in the vertical groove and a pair of resilient arms to deflect horizontally by the engaging protection during insertion of the contact in the cavity and to regulate forward and backward movement of the contact when it is fully inserted in the cavity.

As constructed above, an upwardly-projecting engaging projection is formed on the upper surface of the contact and a pair of horizontally-deflecting resilient arms are formed on the inner wall of the contact-receiving cavity in the housing to regulate forward and backward movement of the contact by engagement with the contact. Consequently, the contact retention function is enhanced without increasing the height of the housing.

Also, the engaging projection of the contact is provided with a vertical groove in the direction of insertion of the contact, and the contact-receiving cavity is provided with a rib on the inner surface to engage with the vertical groove of the engaging projection for preventing the contact from rotating when a twisting moment is applied to the contact.

The electrical connector according to the present invention is limited in height of the housing while firmly retaining the contact in proper position in the contact-receiving cavity in the housing, thereby achieving miniaturization and high reliability of operation of the electrical connector.

Also, the rib in the housing engages the vertical groove in the engaging projection while acting as a guide member during insertion of the contact and positioning the contact for even engagement between the resilient arms and the engaging projection of the contact, thereby further enhancing reliability in contact retention.

BRIEF DESCRIPTION OF THE DRAWINGS

The present invention will be described in detail hereinafter by way of example with reference to the accompanying drawings.

DETAILED DESCRIPTION OF THE INVENTION

Figure 1:
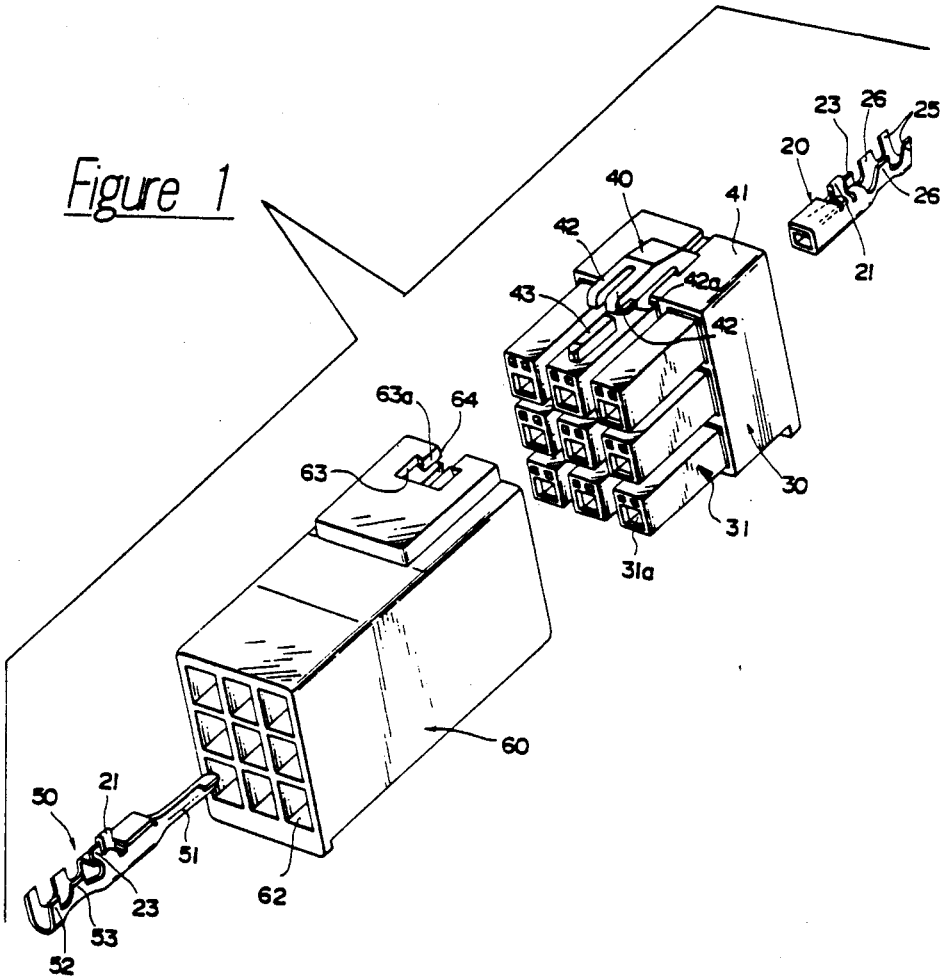
FIG. 1 is an exploded perspective view of the electrical connector according to the present invention.

In FIG. 1, a male connector housing 30 has a desired number of plug sleeve members 31; nine sleeves in this particular example disposed horizontally and vertically in matrix to receive receptacle contacts 20 in a generally-rectangular form. A contact-receiving cavity 31*a* is formed in each plug sleeve member 31.

Provided on the upper surface of the male connector housing 30 is a locking member 40. The locking member 40 extends from the upper surface of the male connector housing 30 and in the same direction as the plug sleeve members 31. A pair of horizontal plug sections 42 are formed as part of the locking member 40. A pair of guide wings 42*a* are formed at both side end portions of the plug sections 42 (note that only one guide wing 42*a* is illustrated in the drawing). A projection member 43 is formed on the upper surface of the upper central plug sleeve member 31 in front of the plug sections 42 in such a manner to cover the gap between the upper surface of the plug sleeve member 31 and the tips of the plug sections 42. The projection member 43 is expected to protect the up-side-down mating with a female connector housing as described hereinafter and also prevent electric wires to be connected to a receptacle contact 20 from accidentally entering the gap between the plug sections 42 and the plug sleeve member 31.

Figure 2:
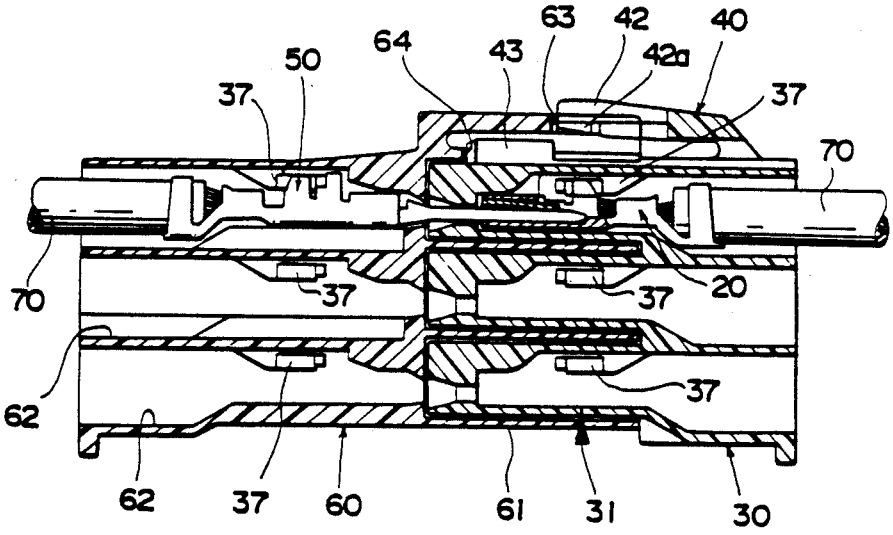
FIG. 2 is a longitudinal cross-sectional view of the electrical connector with the male and female connector housings and tab and receptacle contacts mated with each other.

Female connector housing 60 is to be mated with the above-mentioned male connector housing 30. The female connector housing 60 has a plurality of sleeve-receiving cavities 61 to receive the plug sleeve members 31, as shown in FIG. 2. The sleeve-receiving cavities 61 are about half the length of the female connector housing 60 and sleeve members 31 are inserted from one end thereof toward the other end. Contact-receiving cavities 62 are formed in the remaining half part of the female connector housing 60 for supporting and securing tab contacts 50 inserted in the cavities 62. The sleeve-receiving cavities 61 and the contact-receiving cavities 62 are in communication with one another at the inner sections thereof.

A cut-away portion 63 is formed at the front end of the upper surface of the female connector housing 60 to receive the plug sections 42 of the locking member 40 on the male connector housing 30. A slot 64 is formed open to the end wall below the cut-away portion 63 to receive the projection member 43 The male connector housing 30 and the female connector housing 60 are mated as shown in FIG. 2.

When the plug sleeve members 31 of the male connector housing 30 are to be inserted in the sleeve-receiving cavities 61 in the female connector housing 60, the projection member 43 in front of the locking member 40 slides in the slot 64 of the female connector housing 60, thereby acting as a guide member for the cut-away portion 63 and the plug sections 42. At this time, the guide wings 42*a* at both sides of the plug sections 42 are bent toward each other by the width of the open end 63*a*. When the guide wings 42*a* proceed into the wide cut-away portion 63 while being inwardly bent by the open end 63*a*, the guide wings 42*a* return to their initial positions by the resiliency of plug sections 42 thereby being disposed in the cut-away portion 63. In this manner, both male and female connector housings 30 and 60 are firmly coupled to each other.

By pushing the plug sections 42 downwardly, the rear ends of the guide wings 42*a* are disengaged from the rear ends of the cut-away portion 63 and are unlocked by pulling the male connector housing 30 and female connector housing 60 in opposite directions of this mating.

The internal construction of the male connector housing 30 and the female connector housing 60 is described in detail by reference to FIGS. 2 and 4 through 6.

Figure 4:
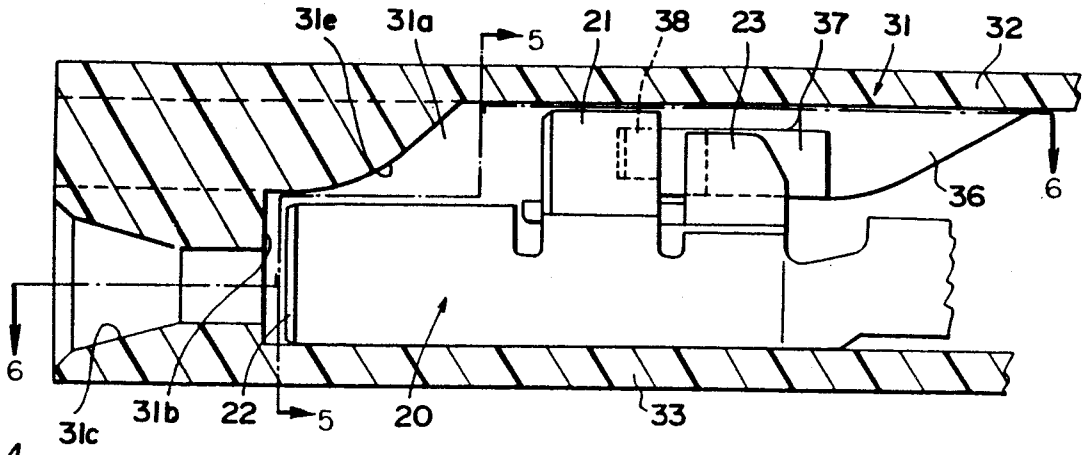
FIG. 4 is a longitudinal cross-sectional view of the plug sleeve member for the male connector housing.
Figure 5:
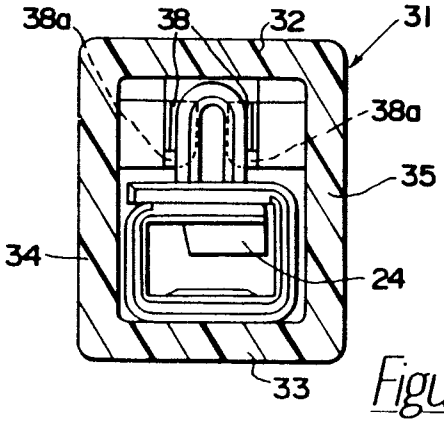
FIGS. 5 and 6 are respectively cross-sectional views along lines 5—5 and 6—6 of FIG. 4.
Figure 6:
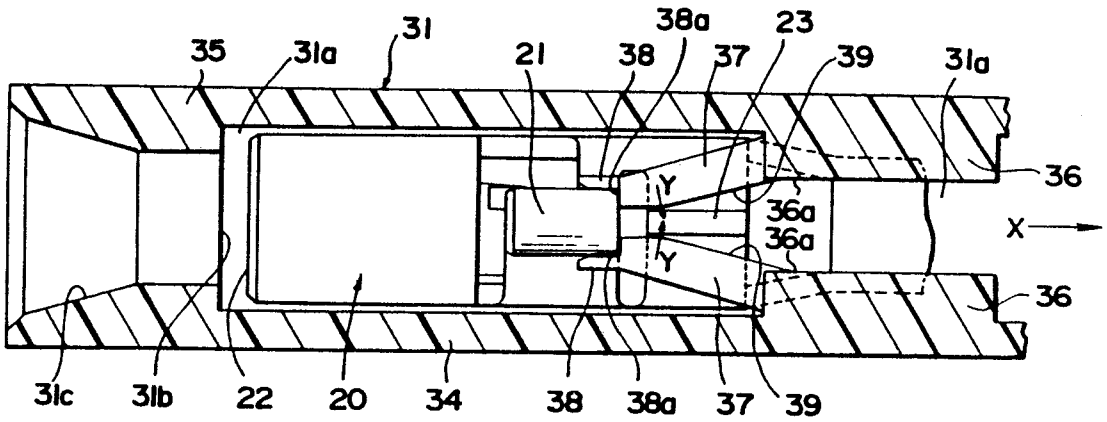
Figure 7:
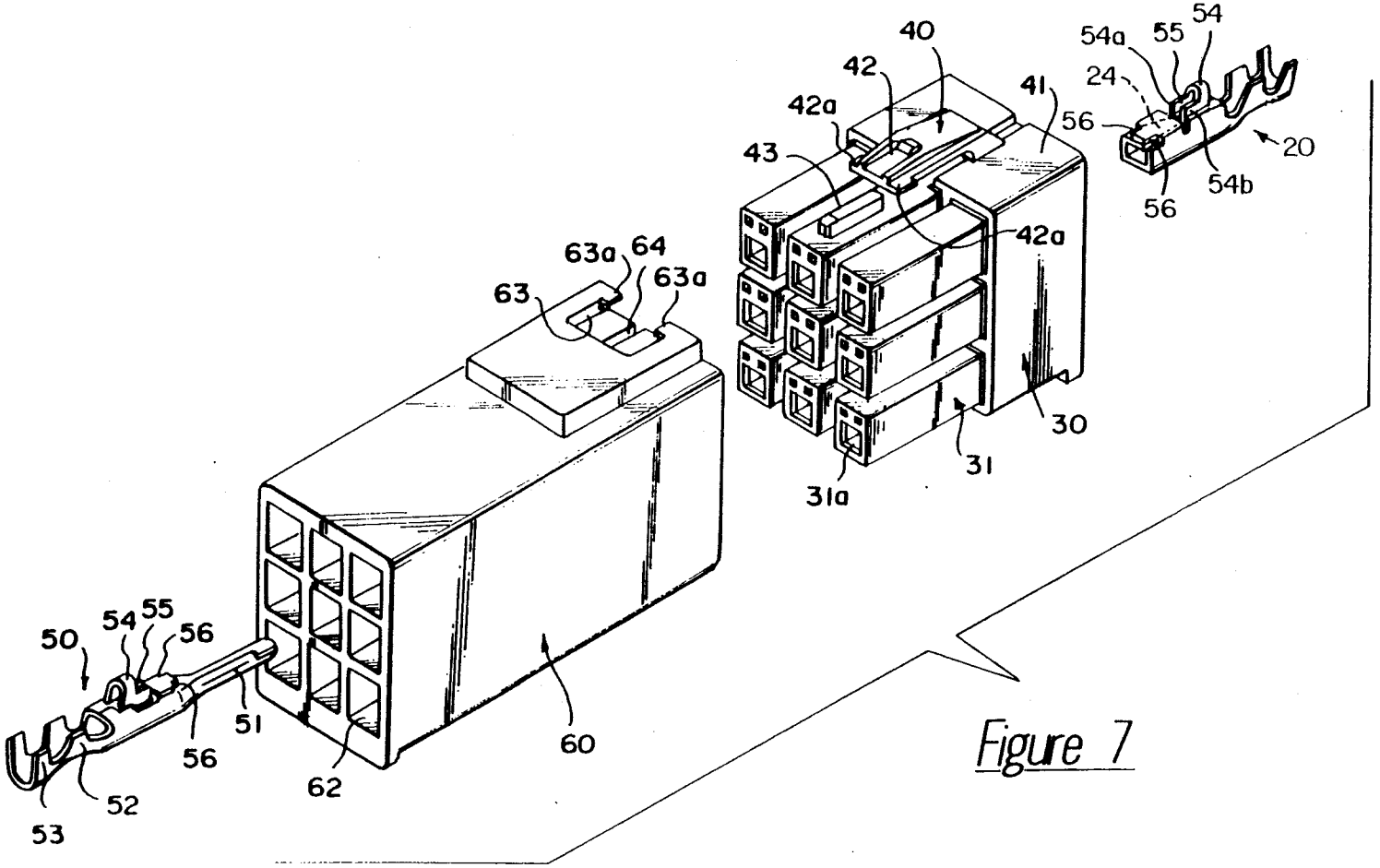
FIG. 7 is an exploded perspective view of the male and female connectors of the electrical connector according to another embodiment of the present invention.
Figure 12:
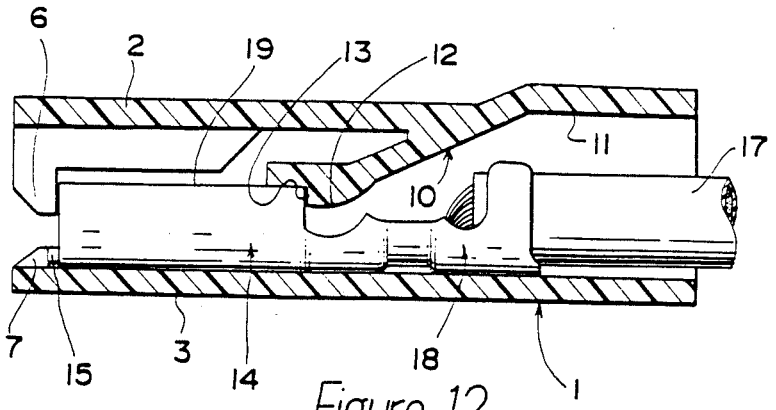
Figure 12 Prior Art
FIG. 12 is a longitudinal cross-sectional view of a conventional electrical connector.
Figure 11:
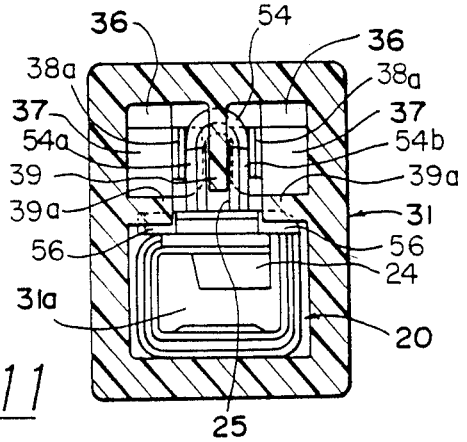
FIGS. 10 and 11 are cross-sectional views along the lines 10—10 and 11—11 of FIG. 9, respectively.
Figure 8:
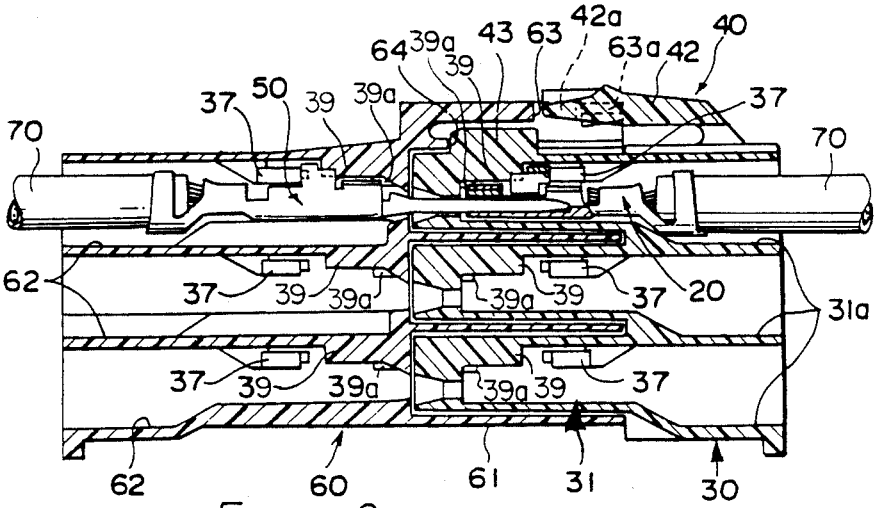
FIG. 8 is a longitudinal cross-sectional view of the mated male and female contacts and housings of FIG. 7.
Figure 9:
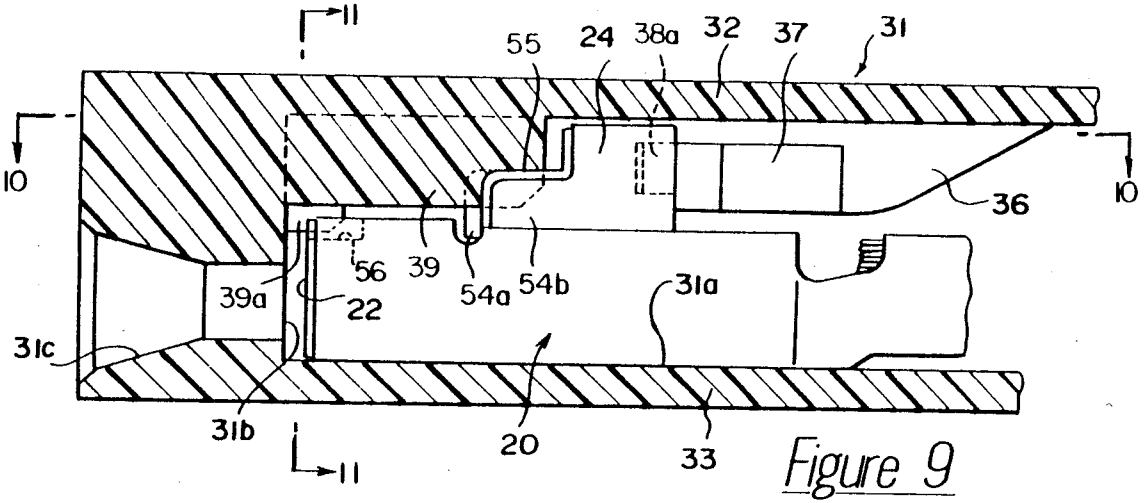
FIG. 9 is a longitudinal cross-sectional view illustrating in detail one of a plurality of plug members of the male connector in FIG. 7.
Figure 10:
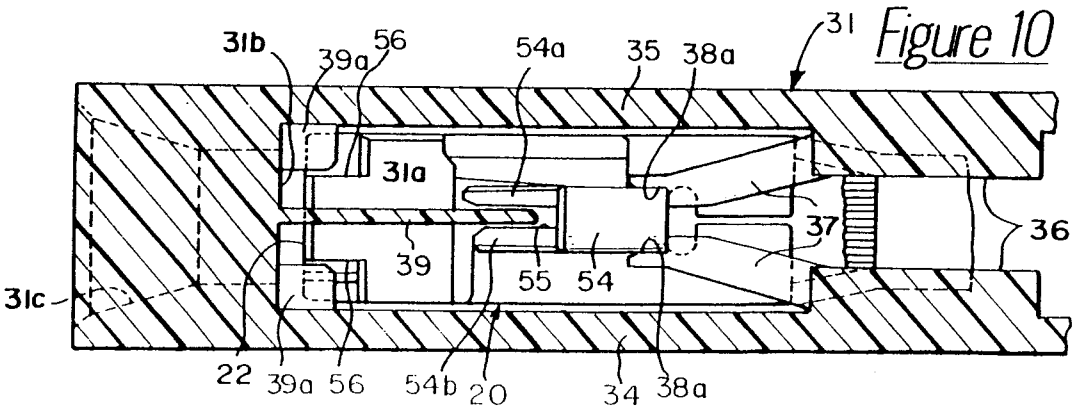

Although FIGS. 4 through 6 show only a single plug sleeve member 31 in which a receptacle contact 20 is inserted, it is to be understood that a plurality of similar plug sleeve members 31 are arranged in matrix in the electrical connector. The plug sleeve members 31 are made in a generally rectangular form from an electrical insulation material such as, for example, nylon. Each plug sleeve member 31 is defined by the upper wall 32, the bottom wall 33 and sidewalls 34, 35. Base portions 36 are formed from the upper wall 32 and sidewalls 34, 35 extending into the plug sleeve member 31. A pair of resilient arms 37 are formed at the base portions 36 extending forwardly and gradually toward the center portion of the contact-receiving cavity 31*a* at the opposed surfaces 36*a*. The resilient arms 37 are horizontal with respect to the bottom wall 33. The resilient arms 37 have tapered surfaces 39 to provide a relatively narrow passageway at the free ends 38 (see FIG. 6). Step portions 38*a* are formed at the free ends 38 to engage the end portion of the horseshoe-shaped engaging projection 21 of the receptacle contact 20, thereby restricting movement opposite to the direction of insertion of the receptacle contact 20 in the contact-receiving cavity 31*a*.

The resilient arms 37 as constructed in the above manner to allow them to move horizontally to widen the gap between the resilient arms 37 by pivotal movement at the base portions 36.

The contact-receiving cavity 31*a* in the plug sleeve member 31 is designed to have sufficient clearance when the receptacle contact 20 is inserted therein. The receptacle contact 20 is restricted from further movement in the direction of its insertion by abutting the front end 22 with the inner surface 31*b* in the contact-receiving cavity 31*a*. Additionally, a smoothly-curved inner surface 31*e* in communication with the inner surface of the upper wall 32 is formed in the contact-receiving cavity 31*a* to act as a guide member for the front end 22 of the receptacle contact 20 when inserted in the cavity 31*a*.

The contact-receiving cavity 31*a* is in communication with a passageway 31*c* leading to the front end of the plug sleeve member 31 in a tapered manner. On the other hand, the other end of the contact-receiving cavity 31*a* is open with sufficient width to allow insertion of the receptacle contact 20 therein as best shown in FIG. 2.

The receptacle contact 20 to be inserted in the contact-receiving cavity 31*a* also has a vertical fin 23 at the rear portion of the engaging projection 21. The vertical fin 23 is positioned between the resilient arms 37 when the receptacle contact 20 is inserted in the cavity 31*a*. As best shown in FIG. 6, when a tensile force is applied to the receptacle contact 20 in the direction X, the vertical fin 23 enhances the strength of the resilient arms 37.

Such resilient arms 37 are formed in each contact-receiving cavity 31*a*. It is to be understood that resilient arms 37 of the same or essentially the same design are formed in each contact-receiving cavity 62 in the female connector housing 60.

Figure 3:
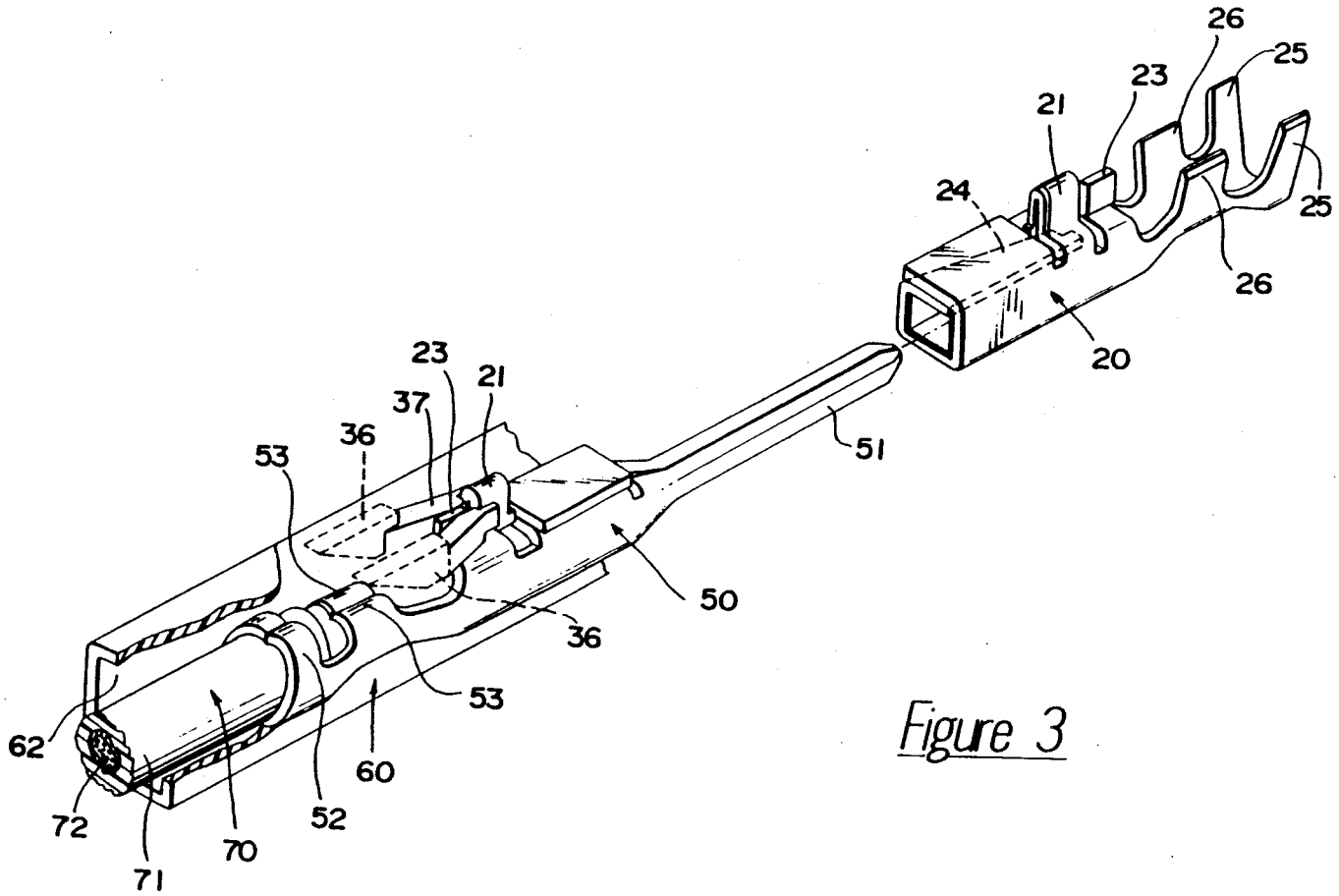
FIG. 3 is a perspective view to illustrate the receptacle contact and the tab contact inserted in the contact-receiving cavity.

Now, reference is made to FIG. 3 illustrating a single receptacle contact 20 and a single tab contact 50 to be inserted in the contact-receiving cavities 31*a* and 62, respectively. In FIG. 3, the receptacle contact 20 is made from a metal plate by stamping and forming in a generally rectangular form. Also, a spring plate contact member 24 is formed to slope down from the upper end as shown by a dotted line. The spring plate contact member 24 springably engages with the upper surface of a contact tab 51 when the receptacle contact 20 receives the contact tab 51 of the tab contact 50, thereby making perfect electrical connection between the receptacle contact 20 and the tab contact 50.

U-shaped double crimping sections 25, 26 and 52, 53 are formed respectively at the rear ends of the receptacle contact 20 and the tab contact 50 for crimping respectively conductors 72 and insulation layer 71 of an electric wire 70.

The operation of the resilient arms 37 will be described in detail by reference to FIG. 6 when the receptacle contact 20 is inserted into the contact-receiving cavity 31*a* from the right end in FIG. 6 of the plug sleeve member 31 toward the left end, the receptacle contact 20 slides forward along the inner surfaces of the walls of the plug sleeve member 31. Then, the engaging projection 21 on the receptacle contact 20 passes through the gap between the opposed base portions 36 to reach the resilient arms 37. The receptacle contact 20 is inserted further under the guidance of the tapered surfaces 39 of the resilient arms 37 to widen the free ends 38 of the resilient arms 37 until the rear end of the engaging projection 21 engages the step portions 38*a*. That is, the resilient arms 37 return to their initial positions by their resiliency and engage the rear end of the engaging projection 21. At this time, the front end 22 of the receptacle contact 20 is restricted to a predetermined position with a certain clearance with end surface 31*b*. The receptacle contact 20 is, then, secured at a predetermined position within the contact-receiving cavity 31*a*.

Similarly, the tab contact 50 is secured within the contact-receiving cavity 62 of the female connector housing 60 with restricted longitudinal movement of the tab contact 50. If any tensile force is applied to the receptacle contact 20 or the tab contact 50 in the direction opposite to the insertion of such contacts, or in the direction of pulling out such contacts, the vertical fin 23 adjacent to the engaging projection 21 remains between the resilient arms 37 to prevent the resilient arms 37 from distorting in the direction Y in FIG. 6. As a result, this ensures that the rear end of the engaging projection 21 and the rear ends of the step portions 38*a* remain engaged and that the receptacle contact 20 and the tab contact 50 are secured at the predetermined position with minimum relative movement between the receptacle contact 20 and the tab contact 50 when they engage one another.

The connector of FIGS. 7–11 is an alternative embodiment wherein the reference numbers are used to identify the same common items of the connector of FIGS. 1–6. Receptacle contact 20 and tab contact 50 of FIGS. 7–11 are the same except they have a U-shaped engaging projection 54 extending upwardly from the upper surface of the contacts. A front half of the engaging projection 54 is cut away forming a pair of flanges 54*a*, 54*b* with a space 55 therebetween. Cut-away portions 56 are formed at both sides of the upper front end of contact 20 and at the rear end of tab contact section 51.

Contact-receiving cavities 31*a* and 62 of housings 30 and 60 of FIGS. 7–11 are the same as those of FIGS. 1–6 except that cavities 31*a* and 62 of FIGS. 7–11 have vertical ribs 39 at the inner ends of the cavities extending downwardly from the upper walls and the inner ends of the cavities. Vertical ribs 39 are slightly thinner than the width of spaces 55 so as to be disposed within spaces 55 of engaging projections 54 between flanges 54*a*, 54*b* when contacts 20, 50 are inserted into cavities 31*a*, 62 to guide the contacts and to prevent the contacts from being rocked when a twisting force is transmitted thereto from wires 70 so that resilient arms 37 maintain even engagement with engaging projections 54 of contacts 20, 50 thereby ensuring contacts 20, 50 are firmly secured in position in the contact-receiving cavities 31*a*, 62.

Projections 39*a* extend toward one another from the inner surfaces of the side walls and the inner ends of cavities 31*a*, 62 adjacent the bottom ends of ribs 39 for disposition in the cut-away portions 56 of contacts 20, 50 when they are inserted in cavities 31*a*, 62. Projections 39*a* enhance the anti-rotation movement of contacts 20, 50 in cavities 31*a*, 62.

The present invention as constructed above firmly secures the receptacle contact and the tab contact in their respective contact-receiving cavities by the operation of the resilient arms. The particular construction enabling the resilient arms to deflect horizontally rather than vertically as in the case of the conventional design will help to reduce the height and thus miniaturize the electrical connector. The vertical ribs and projections at the inner ends of the contact-receiving cavities prevent the contacts from being twisted thereby assuring retention of the contacts therein.

We claim:

1. In an electrical connector comprising a connector housing having at least one contact-receiving cavity formed by opposite upper and lower walls and opposite sidewalls, at least one contact inserted in, said contact-receiving cavity, and contact-retention means to secure said contact in a predetermined position in said contact-receiving cavity, characterized in that:

said contact has an engaging projection extending upwardly from an upper surface, said contact-retention means include a pair of resilient arms extending inwardly from the opposite sidewalls and near the upper wall of said contact-receiving cavity, and said pair of resilient arms having free end sections to restrict movement of said contact to the direction opposite to insertion of said contact by the engagement between said pair of resilient arms and said engaging projection of said contact.

2. An electrical connector of claim 1, characterized in that a vertical fin is provided on the upper surface of said contact to be inserted between said pair of resilient arms.

3. An electrical connector of claim 1, characterized in that said engaging projection has a space, an inner section of a wall of said contact-receiving cavity having a rib to be disposed within said space.

4. An electrical connector of claim 3, characterized in that projections extend toward each other from inner sections of sidewalls of said contact-receiving cavity for disposition in cut-away portions in said contact.

5. An electrical connector comprising:

a dielectric housing having contact-receiving cavities;

electrical contacts having engaging projection means extending outwardly from a surface thereof;

resilient arms extending from sidewalls of said contact-receiving cavities and along said sidewalls toward a front end of said contact-receiving cavities; a free end sections of said resilient arms engaging the engaging projection means thereby retaining the contacts in said contact-receiving cavities.

6. An electrical connector as claimed in claim 5, wherein a fin is located on said contacts adjacent said engaging projection means and is disposed between said resilient arms.

7. An electrical connector as claimed in claim 5, wherein said engaging projection means has a space, a rib is located along an inner section of a wall of said contact-receiving cavities and is disposed in said space.

8. An electrical connector as claimed in claim 5, wherein projections extend toward each other from inner sections of sidewalls of said contact-receiving cavities for disposition in cut-away portions adjacent front ends of said contacts.

* * * * *